US005273172A

United States Patent [19]

Rossbach et al.

[11] Patent Number: 5,273,172

[45] Date of Patent: Dec. 28, 1993

[54] CLOSURE DEVICE FOR DRINKING FROM CONTAINERS

[75] Inventors: Kai Rossbach; Stefan Metzger, both of Offenbach; Peter A. Killmann, Essen, all of Fed. Rep. of Germany

[73] Assignee: Marsteller & Killmann GmbH & Co. KG, Essen, Fed. Rep. of Germany

[21] Appl. No.: 973,754

[22] Filed: Nov. 9, 1992

[30] Foreign Application Priority Data

Nov. 11, 1991 [DE] Fed. Rep. of Germany ..... 4136985

[51] Int. Cl.[5] ..... B65D 47/06; B65D 43/20; B65D 51/18

[52] U.S. Cl. ..... 215/229; 215/1 A; 215/322; 229/103.1; 222/528; 222/529; 222/530; 220/252; 220/256; 220/345; 220/351; 220/703; 220/705; 220/707; 220/708

[58] Field of Search ..... 215/1 A, 229, 235, 309, 215/322; 229/103.1; 220/213, 252, 256, 259, 345, 351, 361, 703, 705, 707, 708, 709, 717; 222/528, 529, 530

[56] References Cited

U.S. PATENT DOCUMENTS

| | | | |
|---|---|---|---|
| 2,529,817 | 11/1950 | Russell | 220/252 X |
| 2,844,267 | 7/1958 | Petriccione | 215/1 A X |
| 2,957,614 | 10/1960 | Krajcovic | 229/103.1 |
| 3,294,293 | 12/1966 | Johns | 222/528 X |
| 3,337,098 | 8/1967 | Johns | 222/528 X |
| 4,925,043 | 5/1990 | Dinand | 215/322 |
| 4,982,854 | 1/1991 | Ichimiya | 215/1 A |
| 5,054,631 | 10/1991 | Robbins | 215/1 A |
| 5,188,283 | 2/1993 | Gu | 229/103.1 |
| 5,203,468 | 4/1993 | Hsu | 220/254 |

FOREIGN PATENT DOCUMENTS

| | | |
|---|---|---|
| 0336168 | 10/1989 | European Pat. Off. . |
| 3708750A1 | 9/1988 | Fed. Rep. of Germany . |

*Primary Examiner*—Allan N. Shoap
*Assistant Examiner*—Vanessa Caretto
*Attorney, Agent, or Firm*—Griffin Butler Whisenhunt & Kurtossy

[57] ABSTRACT

A closure device for drinking from a liquid container (2) is sealingly mounted with a bottom part (3) of a main body thereof extending into an opening of the container. A top part (4) has a circular-arc portion with a groove (6) therein. Liquid-emitting and air-admitting bore holes (10, 11) are positioned in a base of the groove. A pivotally movable cap (14) is mounted on the top part covering the groove. When the cap is pivoted, it causes a flexible hose (12) mounted in the liquid-emitting bore hole to bend and thereby closes it. At the same time, the bent hose closes the air-admitting opening.

6 Claims, 2 Drawing Sheets

CLOSURE DEVICE FOR DRINKING FROM CONTAINERS

BACKGROUND OF THE INVENTION

This invention relates to a closure device for liquid containers having a main body with a bottom part sealing a container opening and a top part defining an approximately-centered liquid-emitting bore hole and a further closable air-admitting bore hole, with the closure device further including a closable drinking hose extending from both sides of the liquid-emitting bore hole and being flexible in at least a portion thereof extending to the outside.

Such a prior-art drinking closure device, known as a "Coleman Sport Bottle", depicted in FIG. 5, is closed by inserting a plug onto an upper end of an outside portion of the drinking hose. This plug has the disadvantage of requiring both hands for opening it, something which is often, for example when riding a bicycle, impossible, or only possible at the risk of an accident.

From prior-art patent document DE-OS 37 08 750 a container, such as a can, for beverages is known wherein a drinking hose is arranged on the inside thereof. In this device, special measures are taken so that the drinking hose "pops" outwardly from a container opening upon the opening thereof, thereby allowing its end to be engaged by a mouth. This action is achieved by means of springs pressing an end of the drinking hose elastically against the removable closure so that the drinking hose, after removal of the closure, extends outwardly from the opening for drinking. The closure is in the form of a removable, or pull-off, loop of a can. This drinking closure device cannot be resealed. In addition, handling of the device is difficult and its activation can certainly not be done with one hand.

From prior-art patent document EP O 336 168 a container closure device is known which can easily be opened and closed, even with one hand. The container has an inflexible pour spout located on a container wall which has a convex and circular-arc shaped surface, onto which is set a cap, movable about a center axis line of the circular-arc shaped portion. The cap has an elastic plug on its inside which closes the opening of the inflexible pour spout when the cap is moved. This closure device has neither a resealable drinking hose nor a resealable opening for air admission and is thus not suitable as a drinking closure device.

It is an object of this invention to provide a drinking closure device wherein both a drinking hose as well as an air-admitting opening are resealable; an outside end of the drinking hose can be covered to protect against contamination; and this cover can be operated easily with one hand.

SUMMARY

According to principles of this invention, a top part of a main body of a closure device has a convex and circular-arc shaped surface extending to both sides of a longitudinal plane passing through a liquid-emitting bore hole; a groove is arranged along the elongated, convex and circular-arc shaped surface; outside openings of the liquid-emitting bore hole and an air-admitting hole are located in a base of the groove; a depth of the groove is smaller than an outer diameter of a flexible, outside portion of a drinking hose; a cap is arranged above the top part to be pivotal about a center axis line of the circular-arc shaped surface; the cap covers a portion of the circular shaped surface; and the inside of the cap is arranged concentric with, but spaced a short distance from, upper longitudinal edges forming the groove, or it bears slidingly against them.

By moving the cap such that it covers the groove, the outside portion of the flexible drinking hose is bent, thus closing itself. In this manner, the drinking hose is laid inside the groove and is pressed against the base of the groove, thereby closing the air-admitting opening at the same time.

In a beneficial embodiment of this invention, the groove extends from the outside liquid-emitting opening to an edge of the top part, thereby ensuring that the groove is completely covered when the cap is in its closing position.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 4:
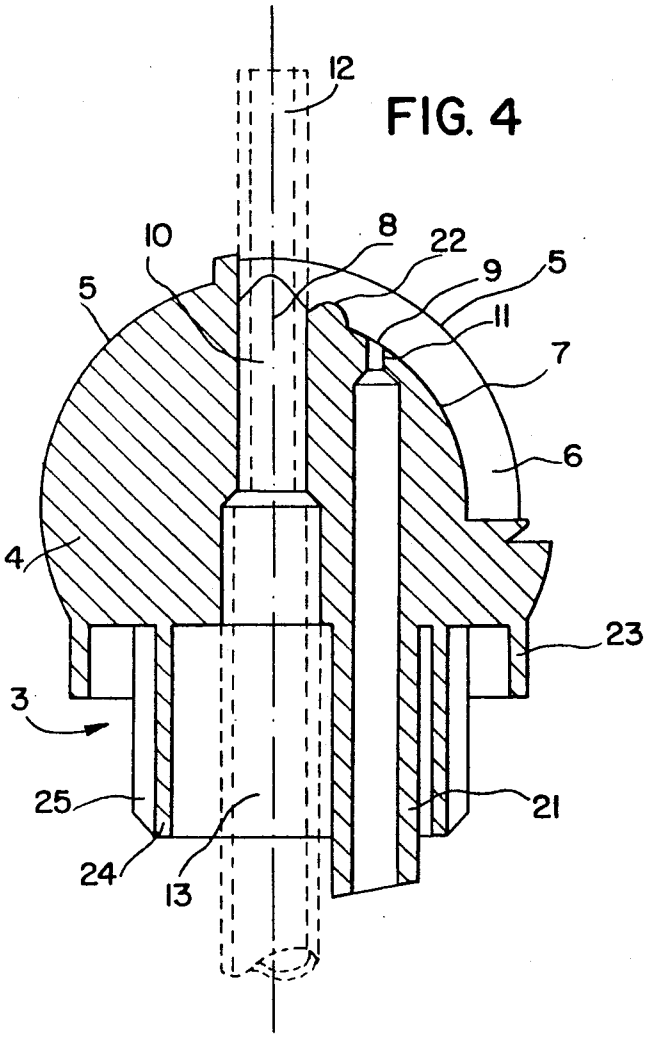
FIG. 4 is a longitudinal cross-sectional view of a beneficial embodiment of a main body of the drinking closure device shown in the other drawings, but without a cap thereon.
Figure 2:
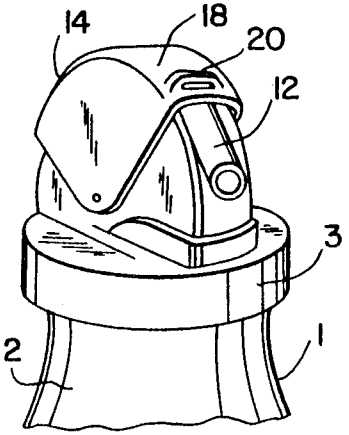
FIG. 2 is a front/side isometric view of the structure of FIG. 1 but with the drinking closure device being partially closed, a groove thereof being half covered.
Figure 1:
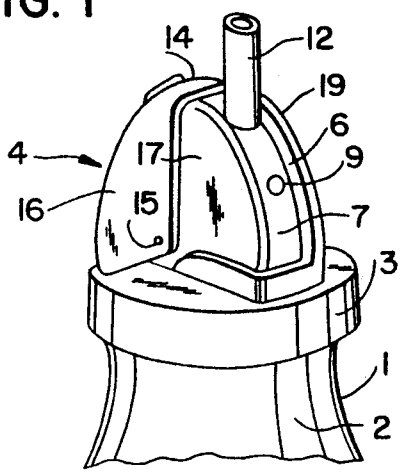
FIG. 1 is a front/side isometric view of an open drinking closure device of this invention mounted on a neck of a liquid container.
Figure 3:
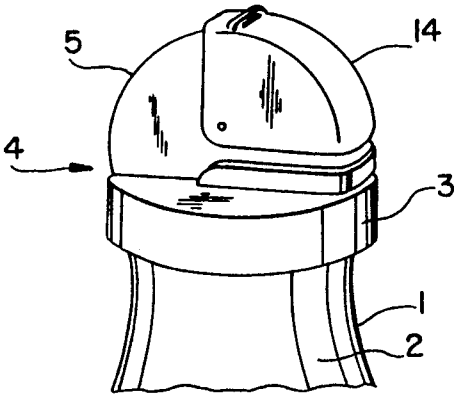
FIG. 3 is a front/side isometric view of the structure of FIG. 1, but with the drinking closure device of this invention being completely closed.
Figure 5:
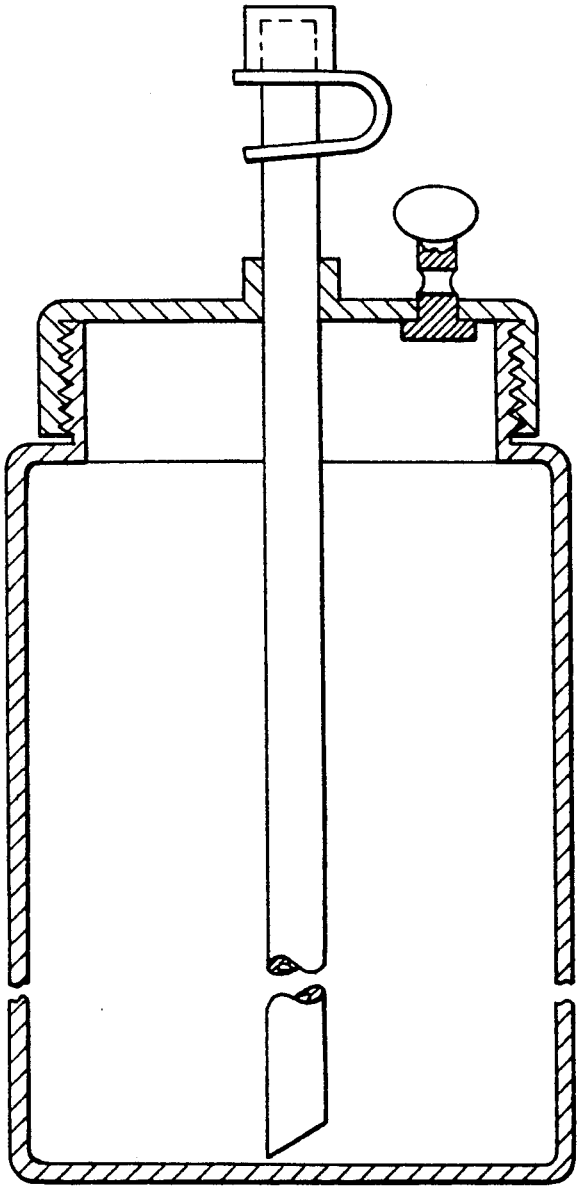
FIG. 5 PRIOR ART
FIG. 5 is a side cross-sectional view of prior-art device.

FIGS. 1–3 depict the neck 1 of a liquid container 2 whose opening is closed by a bottom part 3 of a closure device. A top part 4 of the closure device, built as one piece together with the bottom part 3, is a circular-segmental portion of a disk, or cylinder, mounted on the bottom part at a sectional intersection area. A groove 6 is arranged on a convex and circular, or arc, shaped surface 5 of the segmented cylindrically-shaped top part 4, having outer opening 8 of a bore hole 10 for emission of liquid and outer opening 9 of a bore hole 11 for admission of air. The bore hole 10 for emission of liquid is provided with a drinking hose 12, 13, one end thereof extending from the drinking closure device to the outside and the other end extending to the bottom of the container. This drinking hose may be one piece, however, it is beneficial if it comprises two sections wherein one section 12 enters the closure device through the liquid emitting bore hole 10 from the outside of the container 2 and the other section 13 enters the bore hole 10 from the inside of the container 2, extending at its other end to the container's bottom. In this regard, at least that portion of the drinking hose, extending to the outside, is highly flexible.

The groove 6 does not extend over the entire circular arc 5 of the top part, but rather only over approximately half of the it, that is, from one end of the circular arc 5 to a rear edge of the opening 8 of the liquid-emitting bore hole 10. The remainder of the circular arc 5 is reduced in size by a step to have a smaller radius.

A cap 14, which is pivotally movable about an axis 15, is arranged on top of the top part. The pivotal arrangement can be achieved by axle pins, formed on the inside of the cap and reaching into openings in the top part 4, or vice versa. The cap 14 has the shape of the circular segmental portion of the circular cylinder of the top part 4, with its inside shape corresponding to the outer shape of the top part 4 and with an angle defining its circular-segmental shape being half the size of a corresponding angle defining that of the top part 4. There may be "slop" or clearance between legs 16 of the cap 14 and parallel planes 17 of the cylindrically-shaped top part 4, however, part of a portion 18 forming a cylinder wall of the cap 14 slides alongside upper longitudinal edges 19 defining the groove 6. A depth of the groove 6, and thus an approximate distance between a base 7 of the groove 6 and an inside surface of the cap 14 is smaller than outer dimensions, or a diameter, of the outside drinking hose portion 12. Thereby, closing the cap by pivoting it to a position for closing the groove, bends the portion 12 of the drinking hose to cause it to lie flat inside the groove 6, thereby pressing it together. Thus, the hose is closed with a relatively sharp bend therein and, in addition, the air-admitting opening 9 is closed. The portion 12 of the drinking hose is measured such that it has a length for fitting into the groove 6. For opening the drinking closure device, the cap 14 is pivotally moved back to the opposite end-position. Thus, the flexible, or elastic, portion 12 of the drinking hose stands up by itself, thereby uncovering the liquid and air openings. In order to allow good maneuverability when pivotally moving the cap 14, the cap has a protrusion 20 in an area thereof covering the groove 6.

In order to use the drinking closure device also for pouring, portion 13 of the drinking hose is pulled out of the bore hole 10 and pushed over a connecting portion 21, which is an extension of the air bore hole 11. To allow this, the connection portion 21 has an outer diameter corresponding to a inner diameter of portion 13 of the drinking hose. To prevent liquid located in portion 13 of the hose from exiting bore hole 11 when pouring, a diameter of this bore hole, at least at an end portion thereof, is smaller than that of bore hole 10.

To ensure that the liquid-emitting opening is securely closed, a protrusion, or bump, 22 is arranged, adjacent to the liquid-emitting opening 8, extending upwardly from the base 7 of the groove 6. This protrusion 22 increases compression locally for portion 12 of the drinking hose, thereby providing a further benefit that high compression between the bent hose portion 12 and the cap 14 is limited to a section, so that only a relatively small amount of force is needed to pivotally move the cap.

The bottom part 3 of the drinking closure device is comprised of a hollow plug 24 for sealingly extending into a container opening and of a rim 23 for overlapping the container opening. The hollow plug 24 has outer threads 25 interlocking with inner threads of the container neck 1.

It is beneficial that a portion of the circular arc, which is located adjacent to a end of the groove, has a step spaced a short distance from the groove, so that the circular arc then extends with a smaller radius than other edges of the arc, thereby ensuring that when the cap bears slidingly against the longitudinal edges forming the groove, the force necessary for closing the cap is not unduly increased beyond a high sliding friction at the point where the flexible drinking hose is bent.

It is beneficial that the top part has the shape of a circular-arc of a circular cylinder in cross section, and that it is mounted on the bottom part of the closure device at a sectional-interface area. In this manner, the cap can have the shape of a circular-segmental portion of a hollow circular cylinder in cross section with an interior shape thereof corresponding with its outer shape and with an angle defining its segmental size being approximately half of the corresponding angle defining the segmental size of the top part. This shape of the top part is beneficial not only for manufacturing reasons, but because it also allows better sealing of the groove while, at the same time, the cap is easily movable.

A further beneficial aspect of the invention is that the diameter of the liquid-emitting bore hole is larger than the diameter of the air-admitting bore hole. If the inner portion of the divided drinking hose is connected to the bore hole for air admission, the drinking closure device can be used as a pouring device. Along these lines, it is beneficial that the air-admitting bore hole is defined by a connection portion, or tube extension, directed into the container, its outer diameter corresponding to the inner diameter of the portion of the drinking hose extending into the inside of the container, thus allowing easy conversion of this portion of the drinking hose for forming a pouring device.

To increase sealing reliability of the drinking hose, a protrusion, or bump, extends from the bottom of the groove next to the opening of the liquid-emitting bore hole. Thereby, the closing of the drinking hose is done not only by bending, but also by pressing it together.

While the invention has been particularly shown and described with reference to a preferred embodiment, it will be understood by those of ordinary skill in the art that various changes in form and detail may be made therein without departing from the spirit of the invention. For example, a further solution for achieving the object of this invention involves arranging the groove on the inside of the cap. In this manner, the drinking closure device of this invention would have the following features:

The top part would have a convex and circular-arc shaped surface positioned on both sides of a longitudinal plane passing through a liquid-emitting bore hole thereof;

outer openings of the liquid-emitting bore hole and air-admitting bore hole would lie in a plane, spaced from one another, which is perpendicular to the center axis of the circular arc;

a front-opening groove is arranged on the inside of the cap extending along a line connecting the liquid-emitting and air-admitting openings; and the depth of the groove is smaller than an outer diameter of a portion of an elastic drinking hose extending to the outside.

The embodiments of the invention in which an exclusive property or privilege are claimed are defined as follows:

1. A drinking closure device for liquid-holding containers comprising a main body with a bottom part for closing a container opening and a top part defining a liquid-emitting bore hole and a further, closable, air-admitting bore hole as well as a closable drinking hose extending from both sides of the liquid-emitting bore hole, at least an outer portion of the hose being elastic, wherein the top part has a convex and circular-arc shaped surface on both sides of a longitudinal plane passing through the liquid-emitting bore hole, wherein a groove is located in the convex and circular-arc shaped surface extending along the longitudinal plane, wherein outer openings of the liquid-emitting and air-admitting bore holes are located in a base of the groove, wherein a depth of the groove has a dimension that is smaller than an outer width dimension of the outer portion of the drinking hose, wherein a cap is arranged on the top part, said cap including a pivoting means for pivoting the cap approximately about an axis on a center line of the circular-arc shaped surface, wherein the cap has a shape and size which extends over a portion of the circular-arc shaped surface of the top part, wherein an inside surface of the cap is arranged concentrically to, and close to, upper longitudinal edges defining the groove, and wherein said hose is bendable within said groove upon closing of said cap to close both said bore holes.

2. A drinking closure device for containers as in claim 1 wherein the groove extends from the outer opening of the liquid-emitting bore hole to an edge portion of the top part.

3. A drinking closure device for containers as in claim 2 wherein part of the circular-arc shaped portion close to an end of the groove has a protrusion and then, spaced from the groove, continues in a circular-arc shape to the other end of the edge, but with a smaller radius.

4. A drinking closure device for containers as in claim 1 wherein the top part has the approximate shape of a segment of a cylinder, located at a sectional interface on top of the bottom part.

5. A drinking closure device for containers as in claim 4 wherein the cap has the shape of a hollow cylinder with its inner shape corresponding to an outer shape of the top part and wherein an angle defining a circular segment of the cap is approximately half the size of a corresponding angle defining the top part.

6. A drinking closure device for containers as in claim 1 wherein a diameter of the liquid-emitting bore hole is larger than a diameter of the air-admitting bore hole.

* * * * *